US012312826B1

(12) United States Patent
Gong et al.

(10) Patent No.: US 12,312,826 B1
(45) Date of Patent: May 27, 2025

(54) TOP SUPPORTING MECHANISM FOR A TENT FRAME

(71) Applicant: Heshan Yuehan Umbrella Manufacturing Co., Ltd., Heshan (CN)

(72) Inventors: MingJie Gong, Heshan (CN); ZhaoWen Shi, Heshan (CN)

(73) Assignee: Heshan Yuehan Umbrella Manufacturing Co., Ltd., Heshan (CN)

( * ) Notice: Subject to any disclaimer, the term of this patent is extended or adjusted under 35 U.S.C. 154(b) by 0 days.

(21) Appl. No.: 18/933,562

(22) Filed: Oct. 31, 2024

(51) Int. Cl.
*E04H 15/48* (2006.01)

(52) U.S. Cl.
CPC ..... *E04H 15/48* (2013.01)

(58) Field of Classification Search
CPC ..... E04H 15/48; E04H 15/50
See application file for complete search history.

(56) References Cited

U.S. PATENT DOCUMENTS

| | | | | |
|---|---|---|---|---|
| 9,995,056 | B2 * | 6/2018 | Yang | E04H 15/50 |
| 10,060,153 | B2 * | 8/2018 | Song | E04H 15/34 |
| 10,107,005 | B2 * | 10/2018 | Song | E04H 15/44 |
| 10,273,711 | B2 * | 4/2019 | Song | E04H 15/48 |
| 10,669,738 | B2 * | 6/2020 | Yang | E04H 15/50 |
| 10,941,585 | B2 * | 3/2021 | Sun | E04H 15/50 |
| 10,982,464 | B2 * | 4/2021 | Ying | E04H 15/44 |
| 11,002,036 | B1 * | 5/2021 | Zhang | E04H 15/48 |
| 11,085,201 | B2 * | 8/2021 | Sun | E04H 15/50 |
| 11,199,023 | B2 * | 12/2021 | Sun | E04H 15/50 |
| 11,306,511 | B2 * | 4/2022 | Sun | E04H 15/50 |
| 11,821,228 | B2 * | 11/2023 | Sun | E04H 15/60 |
| 11,988,007 | B2 * | 5/2024 | Liu | E04H 15/32 |

FOREIGN PATENT DOCUMENTS

| | | | |
|---|---|---|---|
| CN | 217712022 U | * | 11/2022 |
| CN | 219952897 U | * | 11/2023 |

* cited by examiner

*Primary Examiner* — David R Dunn
*Assistant Examiner* — Danielle Jackson
(74) *Attorney, Agent, or Firm* — Renner, Otto, Boisselle & Sklar, LLP

(57) ABSTRACT

A top supporting mechanism for a tent frame includes: a mounting base, having a first channel and two mounting grooves within the mounting base, where a movable block movable up and down is arranged in the first channel; a supporting rod, having one end provided with a clamping groove which movably abuts against the movable block, and the other end connected to a top of a tent; two limit blocks, arranged in the mounting grooves, where two sides of each limit block are provided with guide slots connected with edges of the mounting groove, and the limit blocks are movable back and forth along a length direction of the mounting grooves; and a pull handle, including a pull ring and a pull rod, where one end of the pull rod is connected to the movable block, the other end of the pull rod passes through the first channel.

10 Claims, 3 Drawing Sheets

TOP SUPPORTING MECHANISM FOR A TENT FRAME

TECHNICAL FIELD

The present disclosure relates to the technical field of tents, and in particular to a top supporting mechanism for a tent frame.

BACKGROUND

The tent is usually composed of a tent fabric and a tent frame for supporting the tent fabric. The tent frame is composed of a plurality of foldable poles, with the top of each pole connected by a fixed connector. In order to make the tent frame foldable, each pole is connected to the top fixed connector in an articulating manner.

At present, due to the structure of the top fixed connector of the tent frame, it is required to manually set up all the poles one by one when the tent needs to be expanded. Especially, in order to prevent the tent from collapsing from the top while the tent is being expanded, a positioning structure is usually arranged between each of the poles and the top fixed connector as well. During setup, each positioning structure must be individually locked, and during takedown, each pole must be unlocked one by one, making the setup and takedown process significantly inconvenient. Moreover, it is also necessary to arrange fixing mechanisms at the joints between the four corners of the top frame of the tent and the support poles of the tent to fixedly lock the poles with supporting rods at the four corners respectively, which makes installation troublesome and increases the manufacturing cost.

SUMMARY

The present disclosure aims to solve at least one of the technical problems in the existing technology. To this end, the present disclosure provides a top supporting mechanism for a tent frame, which can simplify the installation of a tent and reduce the manufacturing cost of tent frames, and has a compact and practical structure.

The top supporting mechanism for a tent frame according to an embodiment of the present disclosure includes:

- a mounting base, having a first channel and two mounting grooves provided in an inner cavity of the mounting base, where the two mounting grooves are arranged at two sides of the first channel respectively, and a movable block which is movable up and down is arranged in the first channel;
- a supporting rod, having one end provided with a clamping groove, where one end of the supporting rod close to the clamping groove movably abuts against the movable block, and the other end of the supporting rod is connected to a top of a tent;
- two limit blocks, arranged in the mounting grooves, and arranged at two sides of the clamping groove respectively, where two sides of each of the limit blocks are provided with guide slots which are connected with edges of the respective mounting groove in an inserting manner, and the limit blocks are movable back and forth along a length direction of the mounting grooves; and
- a pull handle, comprising a pull ring and a pull rod, wherein one end of the pull rod is inserted in the first channel and connected to the movable block, the other end of the pull rod passes through the first channel, and the pull ring is fixedly connected to one end of the pull rod away from the supporting rod.

The top supporting mechanism for a tent frame according to an embodiment of the present disclosure at least has the following beneficial effects. The supporting rod is inserted from one end of the first channel, the pull rod of the pull handle is inserted from the other end of the first channel and connected to the supporting rod, and the limit blocks and the mounting grooves are arranged in the inner cavity of the mounting base, where both sides of each of the limit blocks are provided with the guide slots which are connected to the edges of the mounting groove in an inserting manner, playing a role in mounting and supporting the limit block on the one hand and guiding the movement of the limit block on the other hand, such that the limit block can move back and forth along the length direction of the mounting grooves and be movably clamped with the clamping groove of the supporting rod, thus locking the supporting rod from moving up and down. When the tent needs to be folded up, connecting rods of a tent frame are folded to drive the top of the tent frame to move downwards, such that the supporting rod moves downwards and the clamping groove is disengaged from the limit blocks at both sides. Further, the supporting rod which is continuously moving downwards pushes the movable block to move downwards in the first channel, and in this case, a user can pull the pull ring downwards by hand to facilitate folding up of the tent, increasing the speed of folding. When the tent needs to be expanded, the user only needs to move supporting legs at the four corners of the tent frame respectively to expand the frame, and while the top of the tent is moving upwards, the supporting rod is driven to move upwards. When the supporting rod moves to a position where the clamping groove corresponds to the limit blocks, the limit blocks are clamped into the clamping groove to prevent the supporting rod from continuing to move upwards. In this case, the pull ring abuts against the external bottom end of the first channel, and at this moment, the tent has been expanded and the tent frame is fixed. Therefore, the user does not need to fixedly lock supporting mechanisms at the four corners of the tent one by one as in the case of a conventional tent, leading to simplified installation, simple operation, and reduced manufacturing cost of tents. It should be noted that when the supporting rod moves downwards, the movable block can abut against the bottom of the first channel to restrain the downward travel of the supporting rod. When the supporting rod moves upwards, the movable block moves upwards and abuts against the bottom of the limit blocks, to facilitate the clamping between the clamping groove and the limit blocks, so as to jointly restrain the upward travel of the supporting rod. Therefore, the structure is simple and practical.

The top supporting mechanism for a tent frame according to an embodiment of the present disclosure further includes a guide slider, where the guide slider is provided with a second channel, one end of the guide slider is movably inserted in the first channel, the movable block is arranged at a bottom of the guide slider, and the supporting rod is inserted in the second channel. The guide slider is configured for guiding the movement of the supporting rod.

In the top supporting mechanism for a tent frame according to an embodiment of the present disclosure, both sides of the second channel are provided with openings through which the limit blocks enter the second channel.

In the top supporting mechanism for a tent frame according to an embodiment of the present disclosure, a top block is provided at a top of the guide slider, which movably abuts against a top of the inner cavity of the mounting base. The top block facilitates the clamping between the clamping groove and the limit blocks and abuts against the limit blocks to jointly restrain the upward travel of the supporting rod, so the structure is simple and practical.

In the top supporting mechanism for a tent frame according to an embodiment of the present disclosure, one end of each of the limit blocks away from the clamping groove is provided with a first spring, and the other end of each of the limit blocks abuts against an inner wall of the mounting base.

In the top supporting mechanism for a tent frame according to an embodiment of the present disclosure, each of the limit blocks is provided with a first positioning block, and one end of the first spring is sleeved on the first positioning block, such that the first positioning block plays a role in positioning and fixing the first spring.

In the top supporting mechanism for a tent frame according to an embodiment of the present disclosure, the inner wall of the mounting base is provided with a second positioning block, and the other end of the first spring is sleeved on the second positioning block, such that the second positioning block plays a role in positioning and fixing the first spring.

In the top supporting mechanism for a tent frame according to an embodiment of the present disclosure, the mounting base includes a base and an upper cover, where the upper cover is arranged to cover the base to form the inner cavity of the mounting base, and the first channel runs through the base and the upper cover.

In the top supporting mechanism for a tent frame according to an embodiment of the present disclosure, a plurality of articulating seats are provided on a top of the upper cover, which are spaced apart around an axis of the upper cover, and the articulating seats are configured for connecting reinforcing rods of the tent frame, so as to enhance stable supporting for the tent.

In the top supporting mechanism for a tent frame according to an embodiment of the present disclosure, a second spring is sleeved on an outer wall of the pull rod, with one end of the second spring abutting against a bottom of the movable block and the other end of the second spring abutting against the pull handle. The second spring is configured for restoring the movable block.

The additional aspects and advantages of the present disclosure will be partially set forth in the following description, and will partially become apparent from the following description or be understood through the practice of the present disclosure.

BRIEF DESCRIPTION OF DRAWINGS

The aforementioned and/or additional aspects and advantages of the present disclosure will become apparent and easily understood from the description of embodiments with reference to the following accompanying drawings, in which.

REFERENCE NUMERALS

Figure 1:
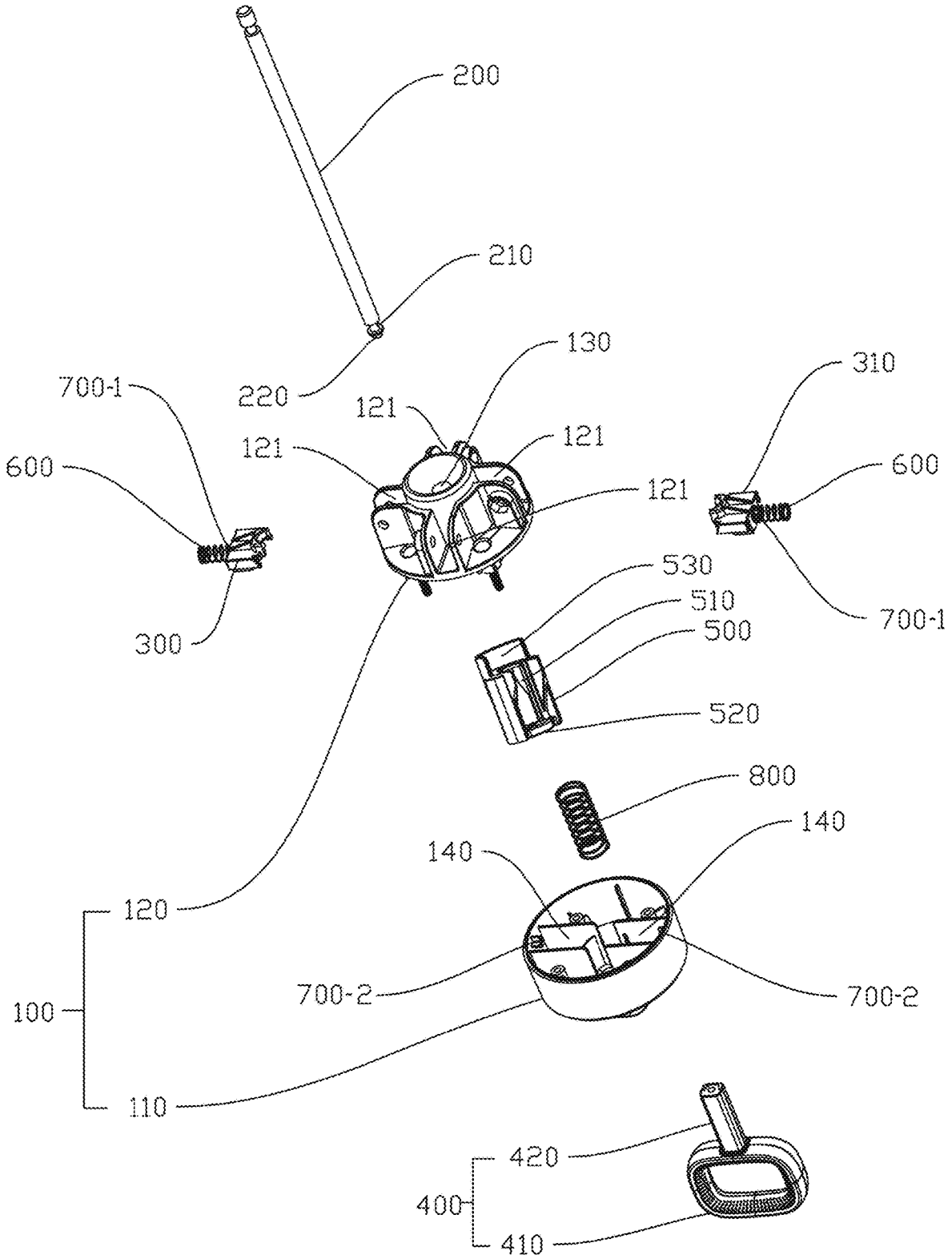
FIG. 1 is an exploded structural view of a top supporting mechanism for a tent frame according to an embodiment of the present disclosure.

Mounting base 100; Base 110; Upper cover 120; Articulating seat 121; First channel 130; Mounting groove 140;

Supporting rod 200; Clamping groove 210; First guide part 220;

Limit block 300; Guide slot 310;

Pull handle 400; Pull ring 410; Pull rod 420;

Guide slider 500; Second channel 510; Movable block 520; Top block 530;

First spring 600;

First positioning block 700-1; Second positioning block 700-2;

Second spring 800.

DETAILED DESCRIPTION

Embodiments of the present disclosure will be described in detail hereinafter with reference to accompanying drawings in which the same or like reference numerals refer to the same or like elements or elements having the same or like functions throughout. The embodiments described below with reference to the accompanying drawings are exemplary and are intended for illustration only and are not to be construed as limiting the present disclosure.

In the description of the present disclosure, it should be understood that for the description of orientations, the orientation or positional relationships indicated by the terms such as "up", "down", "front", "rear", "left", and "right" are based on orientation or position relationships shown in the accompanying drawings, and are used only for ease and brevity of illustration and description, rather than indicating or implying that the mentioned apparatus or element must have a particular orientation or must be constructed and operated in a particular orientation. Therefore, such terms should not be construed as limiting of the present disclosure.

In the description of the present disclosure, the term "at least one" means one or more, the term "plurality of" (or multiple) means two or more, the term such as "greater than", "less than", "exceed" or variants thereof prior to a number or series of numbers is understood to not include the number adjacent to the term. The term "at least" prior to a number or series of numbers is understood to include the number adjacent to the term "at least", and all subsequent numbers or integers that could logically be included, as clear from context. If used herein, the terms such as "first", "second", and the like are merely used for distinguishing technical features, and are not intended to indicate or imply relative importance, or implicitly point out the number of the indicated technical features, or implicitly point out the precedence order of the indicated technical features.

In the description of the present disclosure, unless otherwise explicitly defined, the terms such as "configure", "install/mount" and "connect" should be understood in a broad sense, and those having ordinary skills in the art can reasonably determine the specific meanings of the above terms in the present disclosure based on the specific contents of the technical scheme.

The embodiments of the present disclosure will be further described in detail below with reference to the accompanying drawings.

Figure 2:
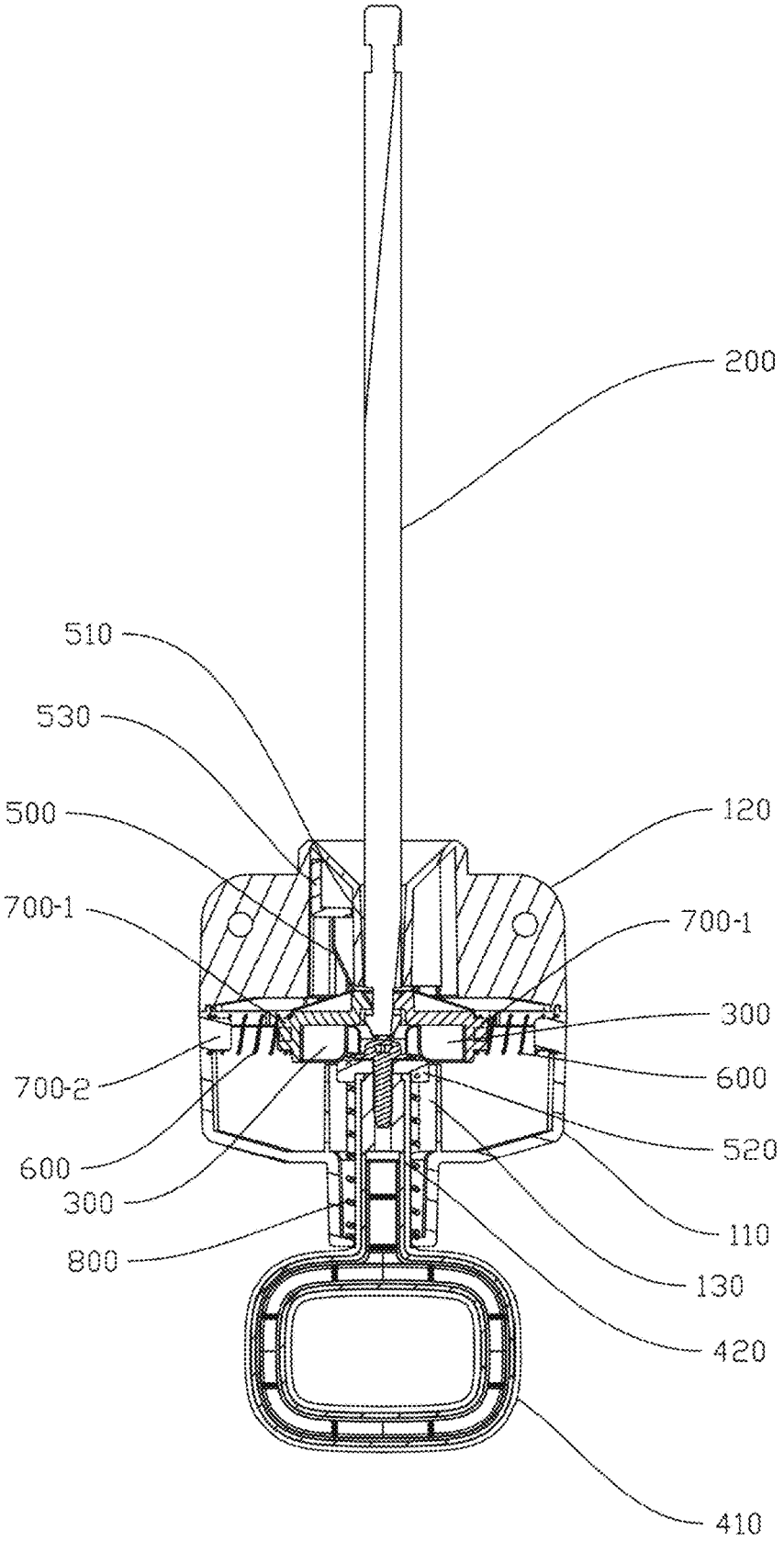
FIG. 2 is a sectional view of the top supporting mechanism for a tent frame according to an embodiment of the present disclosure.
Figure 3:
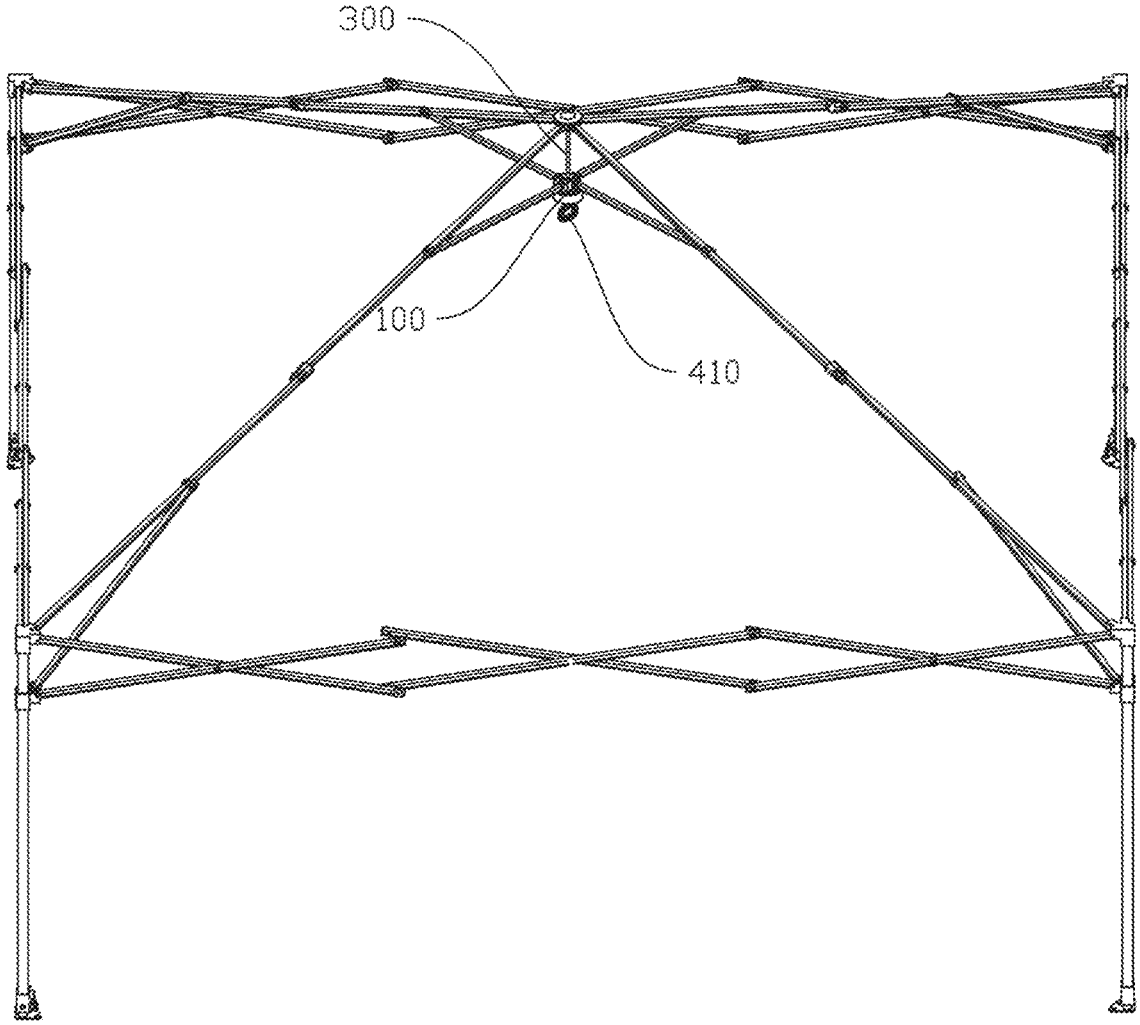
FIG. 3 is a structural view of the supporting mechanism applied to a tent.

Referring to FIGS. 1 to 3, an embodiment of the present disclosure provides a top supporting mechanism for a tent frame, which includes:

a mounting base 100, having a first channel 130 and two mounting grooves 140 provided in an inner cavity of the mounting base 100, where the two mounting grooves 140 are arranged at two sides of the first channel 130 respectively, and a movable block 520 which is movable up and down is arranged in the first channel 130;

a supporting rod 200, having one end provided with a clamping groove 210, where one end of the supporting rod 200 close to the clamping groove 210 movably abuts against the movable block 520, and the other end of the supporting rod 200 is connected to a top of a tent;

two limit blocks 300, arranged in the mounting grooves 140, and arranged at two sides of the clamping groove 210 respectively, where two sides of each of the limit blocks 300 are provided with guide slots 310 which are connected with edges of the respective mounting groove 140 in an inserting manner, and the limit blocks 300 are movable back and forth along a length direction of the mounting grooves 140; and a pull handle 400, including a pull ring 410 and a pull rod 420, where one end of the pull rod 420 is inserted in the first channel 130 and connected to the movable block 520, the other end of the pull rod 420 passes through the first channel 130, and the pull ring 410 is fixedly connected to one end of the pull rod 420 away from the supporting rod 200.

The top supporting mechanism for a tent frame according to an embodiment of the present disclosure at least has the following beneficial effects. The supporting rod 200 is inserted from one end of the first channel 130, the pull rod 420 of the pull handle 400 is inserted from the other end of the first channel 130 and connected to the supporting rod 200, and the limit blocks 300 and the mounting grooves 140 are arranged in the inner cavity of the mounting base 100, where both sides of each of the limit blocks 300 are provided with the guide slots 310 which are connected to the edges of the respective mounting groove 140 in an inserting manner, playing a role in mounting and supporting the limit block 300 on the one hand and guiding the movement of the limit block 300 on the other hand, such that the limit block 300 can move back and forth along the length direction of the mounting groove 140 and be movably clamped with the clamping groove 210 of the supporting rod 200, thus locking the supporting rod 200 from moving up and down. When the tent needs to be folded up, connecting rods of a tent frame are folded to drive the top of the tent frame to move downwards, such that the supporting rod 200 moves downwards and the clamping groove 210 is disengaged from the limit blocks 300 at both sides. Further, the supporting rod 200 which is continuously moving downwards pushes the movable block 520 to move downwards in the first channel 130, and in this case, a user can pull the pull ring 410 downwards by hand to facilitate folding up of the tent, increasing the speed of folding. When the tent needs to be expanded, the user only needs to move supporting legs at the four corners of the tent frame respectively to expand the frame, and while the top of the tent is moving upwards, the supporting rod 200 is driven to move upwards. When the supporting rod 200 moves to a position where the clamping groove 210 corresponds to the limit blocks 300, the limit blocks 300 are clamped into the clamping groove 210 to prevent the supporting rod 200 from continuing to move upwards. In this case, the pull ring 410 abuts against the external bottom end of the first channel 130, and at this moment, the tent has been expanded and the tent frame is fixed. Therefore, the user does not need to fixedly lock supporting mechanisms at the four corners of the tent one by one as in the case of a conventional tent, leading to simplified installation, simple operation, and reduced manufacturing cost. It should be noted that when the supporting rod 200 moves downwards, the movable block 520 can abut against the bottom of the first channel 130 to restrain the downward travel of the supporting rod 200. When the supporting rod 200 moves upwards, the movable block 520 moves upwards and abuts against the bottom of the limit blocks 300, to facilitate the clamping between the clamping groove 210 and the limit blocks 300, so as to jointly restrain the upward travel of the supporting rod 200. Therefore, the structure is simple and practical.

According to some embodiments of the present disclosure, the top supporting mechanism for a tent frame further includes a guide slider 500. The guide slider 500 is provided with a second channel 510, one end of the guide slider 500 is movably inserted in the first channel 130, the movable block 520 is arranged at a bottom of the guide slider 500, and the supporting rod 200 is inserted in the second channel 510. The guide slider 500 is configured for guiding the movement of the supporting rod 200.

According to some embodiments of the present disclosure, both sides of the second channel 510 are provided with openings through which the limit blocks 300 enter the second channel 510.

According to some embodiments of the present disclosure, one end of each of the limit blocks 300 away from the clamping groove 210 is provided with a first spring 600, and the other end of each of the limit blocks abuts against an inner wall of the mounting base 100.

According to some embodiments of the present disclosure, each of the limit blocks 300 is provided with a first positioning block 700-1, and one end of the first spring 600 is sleeved on the first positioning block 700-1, such that the first positioning block 700-1 plays a role in positioning and fixing the first spring 600.

According to some embodiments of the present disclosure, the inner wall of the mounting base 100 is also provided with a second positioning block 700-2, and the other end of the first spring 600 is sleeved on the second positioning block 700-2, such that the second positioning block 700-2 plays a role in positioning and fixing the first spring 600.

According to some embodiments of the present disclosure, the inner wall of the mounting base 100 is also provided with a positioning block 700, and the other end of the first spring 600 is sleeved on the positioning block 700, such that the positioning block 700 plays a role in positioning and fixing the first spring 600.

According to some embodiments of the present disclosure, the mounting base 100 includes a base 110 and an upper cover 120. The upper cover 120 is arranged to cover the base 110 to form the inner cavity of the mounting base 100, and the first channel 130 runs through the base 110 and the upper cover 120.

According to some embodiments of the present disclosure, a plurality of articulating seats 121 are provided on a top of the upper cover 120, which are spaced apart around an axis of the upper cover 120. The articulating seats 121 are configured for connecting reinforcing rods of the tent frame, so as to enhance stable supporting for the tent.

According to some embodiments of the present disclosure, a second spring 800 is sleeved on an outer wall of the pull rod 420, with one end of the second spring 800 abutting against a bottom of the movable block 520 and the other end of the second spring 800 abutting against the pull handle 400. The second spring 800 is configured for restoring the movable block 520.

According to some embodiments of the present disclosure, the supporting rod 200 is provided with a first guide part 220, and each of the limit blocks 300 is provided with a second guide part. Both the first guide part 220 and the second guide part are chamfered, such that the supporting rod 200 can be smoothly connected to the limit blocks 300.

Reference throughout this specification to "an embodiment", "some embodiments", "an example embodiment", "an example", "a specific example", or "some examples" means that a particular feature, structure, material, or characteristic described in connection with the embodiment or example are included in at least one embodiment or example of the present disclosure. In the specification, expressions of the above terms are not necessarily referring to the same embodiments or examples. Furthermore, the feature, structure, material, or characteristic described may be incorporated in a proper way in any one or more embodiments or examples.

Although embodiments of the present disclosure have been shown and described, it can be understood by those having ordinary skills in the art that a variety of changes, modifications, substitutions, and variations can be made to these embodiments without departing from the principles and purposes of the disclosure, and that the scope of the disclosure is limited by the claims and their equivalents.

What is claimed is:

1. A top supporting mechanism for a tent frame, comprising:

a mounting base, having a first channel and two mounting grooves provided in an inner cavity of the mounting base, wherein the two mounting grooves are arranged at two sides of the first channel respectively, and a movable block which is movable up and down is arranged in the first channel;

a supporting rod, having one end provided with a clamping groove, wherein one end of the supporting rod close to the clamping groove movably abuts against the movable block, and the other end of the supporting rod is connected to a top of a tent;

two limit blocks, arranged in the mounting grooves and arranged at two sides of the clamping groove respectively, wherein two sides of each of the limit blocks are provided with guide slots which are connected with edges of the respective mounting groove in an inserting manner, and the limit blocks are movable back and forth along a length direction of the mounting grooves; and a pull handle, comprising a pull ring and a pull rod, wherein one end of the pull rod is inserted in the first channel and connected to the movable block, the other end of the pull rod passes through the first channel, and the pull ring is fixedly connected to one end of the pull rod away from the supporting rod.

2. The top supporting mechanism for a tent frame of claim 1, further comprising a guide slider, wherein the guide slider is provided with a second channel, one end of the guide slider is movably inserted in the first channel, the movable block is arranged at a bottom of the guide slider, and the supporting rod is inserted in the second channel.

3. The top supporting mechanism for a tent frame of claim 2, wherein both sides of the second channel are provided with openings through which the limit blocks enter the second channel.

4. The top supporting mechanism for a tent frame of claim 2, wherein a top block is provided at a top of the guide slider, which movably abuts against a top of the inner cavity of the mounting base.

5. The top supporting mechanism for a tent frame of claim 4, wherein the mounting base comprises a base and an upper cover, the upper cover is arranged to cover the base to form the inner cavity of the mounting base, and the first channel runs through the base and the upper cover.

6. The top supporting mechanism for a tent frame of claim 5, wherein a plurality of articulating seats are provided on a top of the upper cover, which are spaced apart around an axis of the upper cover.

7. The top supporting mechanism for a tent frame of claim 4, wherein a second spring is sleeved on an outer wall of the pull rod, with one end of the second spring abutting against a bottom of the movable block, and the other end of the second spring abutting against the pull handle.

8. The top supporting mechanism for a tent frame of claim 1, wherein one end of each of the limit blocks away from the clamping groove is provided with a first spring, and the other end of each of the limit blocks abuts against an inner wall of the mounting base.

9. The top supporting mechanism for a tent frame of claim 8, wherein each of the limit blocks is provided with a first positioning block, and one end of the first spring is sleeved on the first positioning block.

10. The top supporting mechanism for a tent frame of claim 9, wherein the inner wall of the mounting base is provided with a second positioning block, and the other end of the first spring is sleeved on the second positioning block.

* * * * *